United States Patent [19]

Osawa et al.

[11] Patent Number: 4,933,247

[45] Date of Patent: Jun. 12, 1990

[54] ORGANIC PHOTOSENSITIVE MEMBER WITH NON-DIRECTIVE UPHEAVE PATTERNS ON THE SURFACE OF PROTECTIVE LAYER MADE OF AMORPHOUS CARBON

[75] Inventors: Izumi Osawa; Kenji Masaki, both of Osaka, Japan

[73] Assignee: Minolta Camera Kabushiki Kaisha, Osaka, Japan

[21] Appl. No.: 210,804

[22] Filed: Jun. 24, 1988

[30] Foreign Application Priority Data

Jun. 26, 1987 [JP] Japan ..... 62-160581

[51] Int. Cl.[5] ..... G03G 5/14

[52] U.S. Cl. ..... 430/66; 430/128

[58] Field of Search ..... 430/65, 66, 85

[56] References Cited

U.S. PATENT DOCUMENTS

| | | | |
|---|---|---|---|
| 3,895,136 | 7/1975 | Makishima et al. | 427/257 |
| 3,992,091 | 11/1976 | Fisher | 355/15 |
| 4,134,763 | 1/1979 | Fujimura et al. | 96/1.5 R |
| 4,148,637 | 4/1979 | Kubota et al. | 430/67 |
| 4,242,433 | 12/1980 | Kuehnle et al. | 430/67 |
| 4,382,118 | 5/1983 | Oka | 430/58 |
| 4,409,309 | 10/1983 | Oka | 430/132 |
| 4,426,435 | 1/1984 | Oka | 430/65 |
| 4,514,483 | 4/1985 | Matsuura et al. | 430/84 |
| 4,634,648 | 1/1987 | Jansen et al. | 430/84 |
| 4,687,723 | 8/1987 | Oshima et al. | 430/65 |
| 4,740,440 | 4/1988 | Honda et al. | 430/66 |
| 4,770,966 | 9/1988 | Kazama et al. | 430/66 |

FOREIGN PATENT DOCUMENTS

| | | |
|---|---|---|
| 53-92133 | 8/1978 | Japan . |
| 56-144433 | 11/1981 | Japan . |
| 58-59454 | 4/1983 | Japan . |

*Primary Examiner*—John L. Goodrow

*Attorney, Agent, or Firm*—Burns, Doane, Swecker & Mathis

[57] ABSTRACT

The present invention provide a photosensitive member comprising at least an organic photoconductive layer and a surface protective layer on an electrically conductive substrate, wherein the surface protective layer comprises an amorphous carbon layer with non-directive upheave patterns, which is formed by a glow discharge method.

A photosensitive member of the invention is excellent in the reproducibility of fine lines as well as the improvement of the prevention of filming phenomenon.

A photosensitive member of the invention can be used for a long time.

8 Claims, 6 Drawing Sheets

ORGANIC PHOTOSENSITIVE MEMBER WITH NON-DIRECTIVE UPHEAVE PATTERNS ON THE SURFACE OF PROTECTIVE LAYER MADE OF AMORPHOUS CARBON

BACKGROUND OF THE INVENTION

This invention relates to a photosensitive member with non-directive upheave patterns on the surface.

A protective layer is formed on a surface of an organic photosensitive member to improve the durability, the copy-image properties and so on.

An organic photosensitive member with a surface protective layer made up of organic polymer has yet such a problem about the durability as the poor resistance to wear particularly caused by the poor damage resistance to the friction of the member with toners, carriers, recording sheets and cleaning means, because the organic photosensitive member is used in a copying machine under severe conditions such as charging, exposing to light, developing, transferring, discharging and cleaning.

Further, toners, carriers or polymeric resins contained therein adhere on the surface of a photosensitive member to form a thin layer during the development (called "filming phenomenon").

The thin layer formed on the photosensitive member is transferred to copy paper to form undesired copy images (called "fog phenomenon").

Japanese Patent KOKAI Nos. 92133/1978 and 14443/1981 disclose that an rough surface of a photosensitive member improves the image properties such as image disorder, gradient and so on.

A photosensitive member with irregularities on the surface of the organic photosensitive layer, which is disclosed in Japanese Patent KOKAI No. 144433/1981, can copy only 20000 sheets of paper at most, because the irregularities are shaved in the copying process on account of the poor resistance to wear.

Japanese Patent KOKAI No. 92133/1978 discloses a photosensitive member with the surface protective layer, the roughness of which is 0.1S–10S, but it is an inorganic one of selenium type and differs from an organic photosensitive member of the present invention.

The both photosensitive members above mentioned have such problems as the noises in images caused by the surface pollution of abrasive agents or the peeling off of a photosensitive layer caused by the pressure at polishing, because the surface irregularities are formed by making the surface rough with abrasive agents.

SUMMARY OF THE INVENTION

The object of the invention is to provide a photosensitive member excellent in the reproducibility of fine lines.

An other object of the invention is to provide a photosensitive member excellent in the durability such as damage resistance.

An other object of the invention is to provide a photosensitive member which does not bring about filming phenomena.

The present invention relates to a photosensitve member comprising at least an organic photoconductive layer and a surface protective layer on an electrically conductive substrate, wherein the surface protective layer comprises an amorphous corbon layer with non-directive upheave patterns, which is formed by a glow discharge method.

DETAILED DESCRIPTION OF THE INVENTION

A surface protective layer with non-directive upheave patterns formed by an organic-plasma polymerization method was found to be effective for durability, the prevention of the generation of filming phenomena and the reproducibility of fine lines.

The present invention provides a photoseisitive member with above mentioned surface protective layer excellent in durability, the prevention of generation of filming phenomena and the reproducibility of fine lines.

The present invention relates to a photosensitive member comprising at least an organic photoconductive layer and a surface protective layer on an electrically conductive substrate, wherein the surface protective layer comprises an amorphous carbon layer with non-directive upheave patterns, which is formed by a glow discharge method.

Figure 1:
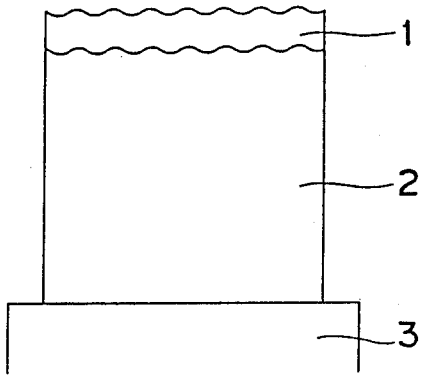
FIG. 1 is a schematic sectional view of a photosensitive member of the invention.

A schematic view showing the sectional structure of a photosensitive member of the invention is shown in FIG. 1.

A photosensitive member of the invention comprises at least two layers on or over an electrically conductive substrate; one is an organic photoconductive layer (2) and the other is a surface protective layer (1) with non-directive upheave patterns.

An organic photoconductive layer (2) per se known can be used, for example the ones described in NIKKEI NEW MATERIALS, page 83–Page 98, (Dec. 15, 1986), and other ones practically used and excellent in sensitivity, chargeability, cost performance for productivity and so on.

As regards to materials for the preparation of an organic photoconductive layer, photoconductive materials playing a part of the charge generation are organic substances such as phthalocyanine pigments, azo pigments, perylene pigments and so on, and charge transporting materials playing a part of the charge transportation are organic substances such as triphenyl methane compounds, triphenylamine compounds, hydrozone compounds, styryl compounds, pyrazoline compounds, oxazol compounds, oxadiazole compounds and so on. Binder resin for the dispersion of above mentioned substances are, for example, polyester resin, polyvinyl butyral resin, polycarbonate resin, polyallylate resin, phenoxy resin, styrene acryric resin, etc..

A photoconductive layer of the invention may be one of a monolayer type wherein both a charge generating materials and a charge transporting materials are dispersed in a binder resin or one of laminated type with a charge generation layer and a charge transporting layer.

A surface protective layer (1) is formed on the above mentioned photoconductive layer (2) and comprises an amorphous carbon (hereinafter called "a-C") layer constituted of carbon atom and hydrogen atom.

The hydrogen content of a surface protective layer is 0.1–67 atomic percents (hereinafter abbreviated to "atm. %"), preferably 10–55 atm. %, more preferably 20–50 atm. % on the basis of the total number of all atoms constituting the surface protective layer. The surface protective layer, hydrogen content of which is less than 0.1 atm. %, is fragile and liable to peel off and crack. If the hydrogen content of the surface protective layer is more than 67 atm. %, the layer hardness gets low and the resistance to wear becomes poor.

The surface of a surface protective layer of the invention has non-directive upheave patterns. Non-directive upheave patterns expressed such patterns that for example, if the surface of a photosensitive member is observed from above it, upheavals are not only formed as straight lines or spots but also formed as they continuously wind up and down or right and left.

Figure 7:
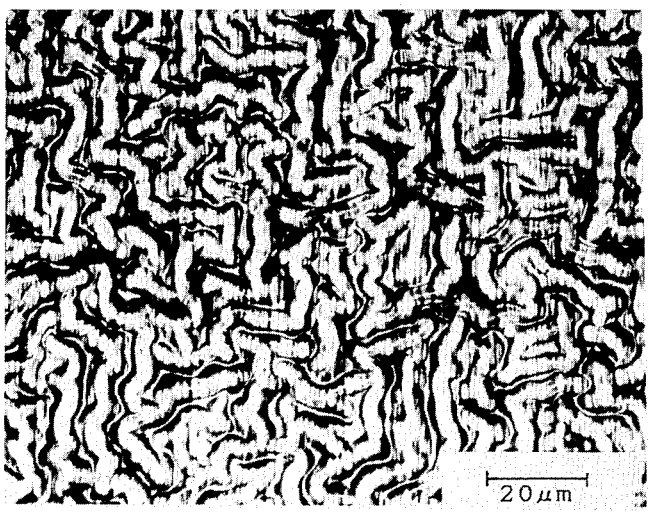
FIG. 7 is a photograph of typical microstructure of non-directive upheave patterns formed on an organic photoconductive layer on an aluminium substrate (magnified ratio is 150).

A surface structure of non-directive upheave patterns formed on an organic photoconductive layer is shown in FIG. 7 as a referential photograph (magnified ratio is 150).

Figure 8:
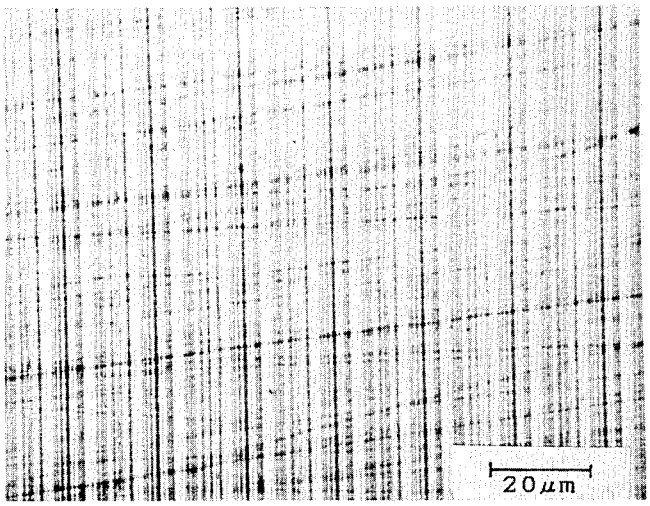
FIG. 8 is a photograph of microstructure of the surface of a polished organic photoconductive layer on an aluminium substrate (magnified ratio is 150).

For the easy understanding, the surface structure of only polished organic photoconductive layer on an aluminium drum is shown in FIG. 8 as a referential photograph (magnified ratio is 150).

It is understood that linear lines resulted from polishing of an organic photoconductive layer on an aluminium drum are observed in FIG. 8, but black curved lines which are sloping parts between protuberant parts and hollow parts, and white curved lines which are the tops of protuberant parts and the bottoms of hollow parts are observed to be non-directive in FIG. 7.

The protuberant parts are formed to be winding non-directively and irregularly. The winding lines must be not necessarily curved but also may be smoothly or sharply broken or cut in the lines.

Non-directive upheave patterns of the invention are expressed concretely as the roughness of protuberant parts.

Figure 2:
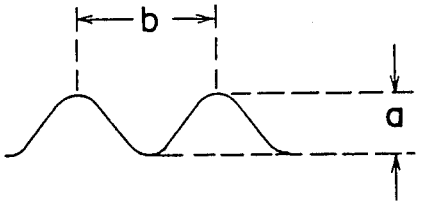
FIG. 2 is a schematic sectional view of a protuberant part of a surface protective layer.

A schematic sectional view of a protuberant part of a line is shown in FIG. 2 in order to explain the roughness in the specification. The roughness means the distance (a) between a top of protuberant part and an adjoining bottom of a hollow part.

Desirable protuberant parts of a surface protective layer of the invention has the roughness (a) of 0.1–20 μm, preferably 0.2–15 μm, more preferably 0.3–10 μm.

If the roughness (a) is less than 0.1 μm, the reproducibility of fine lines, which is one of the objects of the invention, can't be achieved satisfactorily. If the roughness (a) is more than 20 μm, the toner cleaning properties are impaired.

On the other hand, the desirable distance (b) between a top of a protuberant part and an adjoining top of a protuberant part is 1–40 μm, preferably 2–30 μm, more preferably 3–20 μm.

If the distance (b) is less than 1 μm, the reproducibility of fine lines, which is one of the objects of the invention, can't be achieved satisfactorily. If the distance (b) is more than 40 μm, the toner cleaning properties are impaired.

A surface protective layer of the invention is formed by plasma-polymerizing, for example, hydrocarbon compounds to be 0.05–5 μm, preferably 0.1–2.5 μm, more preferably 0.2–1.2 μm in thickness according to various kinds of plasma methods such as direct current, radio frequency, audio frequency, micro wave plasma, etc..

At the plasma-polymerization for the formation of a surface protective layer, an organic photoconductive layer containing resin may soften with heat, and when the surface protective layer is cooled, non-directive upheave patterns are formed on its surface. Unless an organic photoconductive layer softens at the plasma-polymerization non directive upheave patterns may be formed by annealing an obtained photosensitive member with a flat surface protective layer.

By the way, the thickness of a surface protective layer means the shortest distance from a bottom between protuberant parts to an organic photoconductive layer(2).

If the thickness of a protective layer is less than 0.01 μm, the layer is liable to peel off from an organic photoconductive layer (2) because of unenough resistance to shearing forces generated by the contact with various members in a copying machine at practical use.

If the thickness of a protective layer is more than 5 μm, it is difficult to obtain a surface protective layer with good electrostatic properties because the residual potential tends to increase.

Because a protective layer formed by plasma-polymerization has enough hardness (3H-9H in pencil hardness of JIS-K-5400), the protuberant parts of the surface of protective layer is hard to be damaged by developing agents or a cleaning means such as a blade, etc., so the protective layer is excellent in durability.

Hydrocarbon compounds are used for the preparation of a surface protective layer of the invention. The hydrocarbon compounds are not always gas, but may be liquid or solid materials providing that the materials can be vaporized by means of melting vaporizaiton, sublimation, or the like when heated or vacuumed.

A hydrocarbon for this purpose can be selected from among, for example, saturated hydrocarbons, unsaturated hydrocarbons, alicylic hydrocarbons, aromatic hydrocarbons, and the like. Further, these hydrocarbons can be mixed.

Examples of the saturated hydrocarbons applicable in this respect are;

normal-paraffins—methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; and isoparaffins—isobutane, isopentane, neopentane, isohexane, neohexane, 2,3-dimethylbutane, 2-methylhexane, 3-ethylpentane, 2,2-dimethylpentane, 2,4 dimethylpentane, 3,3-dimethylpentane, tributane, 2-methylheptane, 3-methylheptane, 2,2-dimethylhexane, 2,2,5-trimethylhexane, 2,2,3,-trimethylpentane, 2,2,4-trimethylpentane, 2,3,3-trimethylpentane, 2,3,4-trimethylpentane, isononane, etc.

Example of the unsaturated hydrocarbons applicable in this respect are:

olefins—ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene, etc.;

diolefins—allene, methylallene, butadiene, pentadiene, hexadiene, cyclopentadiene, etc.; and triolefins—ocimene, allo-ocimene, myrcene, hexatriene, etc.

Examples of the acetylene series hydrocarbons applicable in this respect are:

acetylene, diacetylene, methylacetylene, 1-butyne, 2-butyne, 1-pentyne, 1-hexyne, 1-heptyne, 1-octyne, 1-nonyne, and 1-decyne.

Examples of the alicyclic hydrocarbons applicable in this respect are:

cycloparaffins—cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane, etc.;

cycloolefins—cyclopropene, cyclobutene, cyclopentene, cyclohexene, cycloheptene, cyclooctene, cyclononene, cyclodecene, etc.;

terpenes—limonene, terpinolene, phellandrene, silvestrene, thujene, caren, pinene, bornylene, camphene, fenchene, cyclofenchene, tricyclene, bisabolene, zingiberene, curcumene, humulene, cadine-sesquibenihen, selinene, caryophyllene, santalene, cedrene, camphorene, phyllocladene, podocarprene, mirene, etc.; and steroids.

Examples of the aromatic hydrocarbons applicable in this respect are:

benzene, toluene, xylene, hemimellitene, pseudocumene, mesitylene, prehnitene, isodurene, durene, pentamethyl benzene, hexamethyl benzene, ethylbenzene, propyl benzene, cumene, styrene, biphenyl, terphenyl, diphenylmethane, triphenylmethane, dibenzyl, stilbene, indene, naphthalene, tetralin, anthracene, and phenanthrene.

A surface protective layer can be modified with the incorporation of additives.

Illustrative examples of such additives are halogen atoms, oxygen atom, nitrogen atom, atoms of group IV in the periodic table, atoms of Group III in the periodic table, atoms of Group V in the periodic table and so on.

The incorporation of halogen atoms gives a protective layer slipping properties and effects the prevention of filming phenomenon. Halogen atoms include fluorine, chlorine, bromine etc., and in particular, the incorporation of fluorine is effective.

The incorporation content of halogen atoms is 0.05 atm. % or more, preferably 0.1 atm. % or more preferably 0.2 atm. % or more on the basis of the total number of all atoms in a protective layer. If the content is less than 0.05 atm. %, some kinds of developing agents may cause filming phenomenon.

Haolgen atoms can be incorporated in a protective layer by polymerizing hydrocarbon gases together with the gases of compounds containing those atoms under plasma conditions or ionized conditions.

Examples of halogen-atom-containing compounds are trifluoromethane, tetrafluoromethane, vinylidene fluoride, vinyl fluoride, hexafluoroethane, perfluoropropane and so on.

The incorporation of oxygen atom or nitrogen atom is effective for the improvement of the time-dependent stability of optical properties such as translucence and refractive index, etc. of a protective layer.

The incorporation content of oxygen atom or nitrogen atom is 0.1 atm. % or more, preferably 0.5 atm. % or more, more preferably 1 atm. % or more on the basis of the total number of all atoms in a protective layer. If the content is less than 0.1 atm. %, some kinds of light sources may affect delicate change of sensitivity on account of the change of transmittance with time.

Oxygen atom or nitrogen atom can be incorporated in protective layer by polymeriging hydrocarbon gases together with the gases of compounds containing those atoms under plasma conditions or ionized conditions.

Examples of compounds containing oxygen or nitrogen are oxygen molecules, carbon monoxide, carbon dioxide, methanol, formic acid, acetone, dimethyl ether, nitrogen molecules, ethylenediamine, butylamine, nitrogen monoxide, nitromethane, air and so on.

The incorporation of atoms of Group IV in the periodic table is effective for the cut of light with short wavelength. The incorporation effect is given particularly to such a photosensitive member that the sensitivity is diminished by short wavelength light.

Examples of atoms of Group IV in the periodic table are silicon, germanium, tin and the like. The incorporation content thereof is 0.1–50 atm. %, preferably 0.5–30 atm. %, more preferably 1–20 atm. % on the basis of the total number of all atoms in a protective layers. If the content is 0.1 atm. % or less, some kinds of photosensitive members are liable to be deteriorated by short wavelength light resulting in lowered sensitivity. If the content is more than 50 atm. %, the translucence is diminished, resulting in lowered sensitivity.

Atoms of Group IV in periodic table can be incorporated in a protective layer by polymerizing hydrocorbon gases together with the gases of compounds containing atoms of Group IV in the periodic table under plasma conditions or ionized conditions.

Examples of compounds containing atoms of Group IV in the periodic table are silane, disilane, germane, etc.

The incorporation of atoms of group III in the periodic table is effective for the prevention of the charge injection from the surface of negatively chargeable photosensitive member.

Examples of atoms of Group III in the periodic table are boron, aluminium, gallium, indium, etc.. The incorporation content is 0.1 atm. % or more, preferably 0.5 atm. % or more, more preferably 1 atm. % or more on the basis of the total number of all atoms in a protective layer.

If the content is less than 0.1 atm. %, the chargeability of some kinds of photosensitive members may be diminished because of charges' injection from the surface.

Atoms of Group III in the periodic table can be incorporated in a protective layer by polymerizing hydrocarbon gases together with the gases of the compounds containing those atoms under plasma conditions or ionized conditions.

Examples of compounds containing atoms of Group III in the periodic table are diborane, trimethylaluminium, triethyl gallium.

The incorporation of atoms of Group V in the periodic table is effective for the prevention of the charge injection from the surface of positively chargeable photosensitive member.

Examples of atoms of Group V in the periodic table are phosphorus, arsenic, antimony, etc.. The incorporation content is 0.1 atm. % or more, preferably 0.5 atm. % or more, or more preferably 1 atm. % or more on the basis of the total number of all atoms in a protective layer. If the content is less than 0.1 atm. %, the chargeability of some kinds of photosensitive members may be diminished because of charges' injection from the surface.

Atoms of Group V in the periodic table can be incorporated in a protective layer by polymerizing hydrocarbon gases together with the gases of compounds containing those atoms under plasma conditions or ionized conditions.

Examples of compounds containing atoms of Group V in the periodic table are phosphine, arsine, triethyl antimony, etc..

Figure 3:
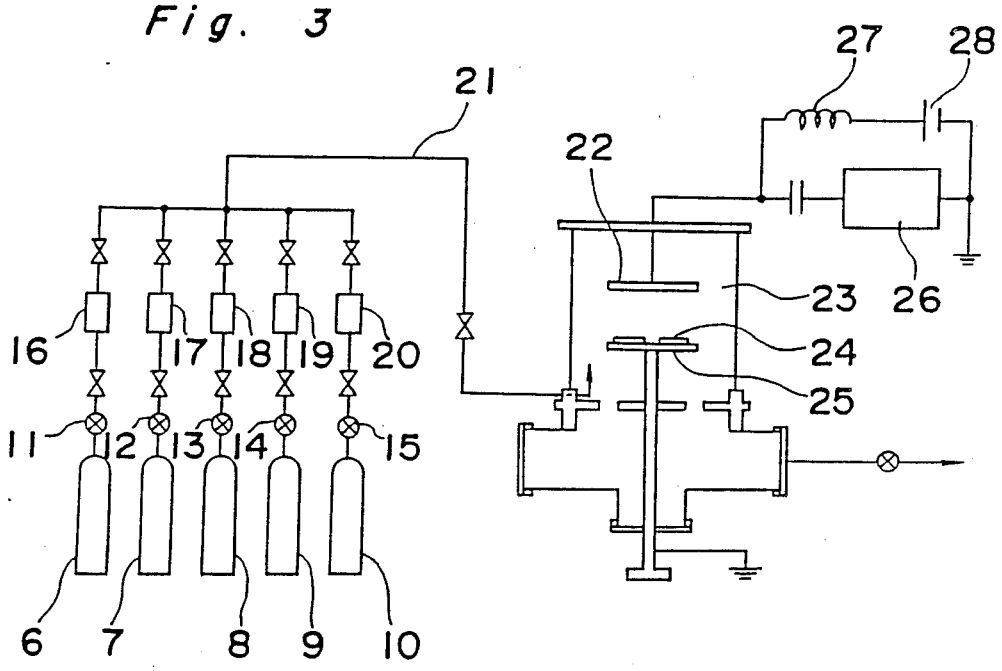
FIG. 3, FIG. 4 and FIG. 5 are schematic views of equipments for the preparation of a surface protective layer on a photoconductive layer of the invention.
Figure 4:
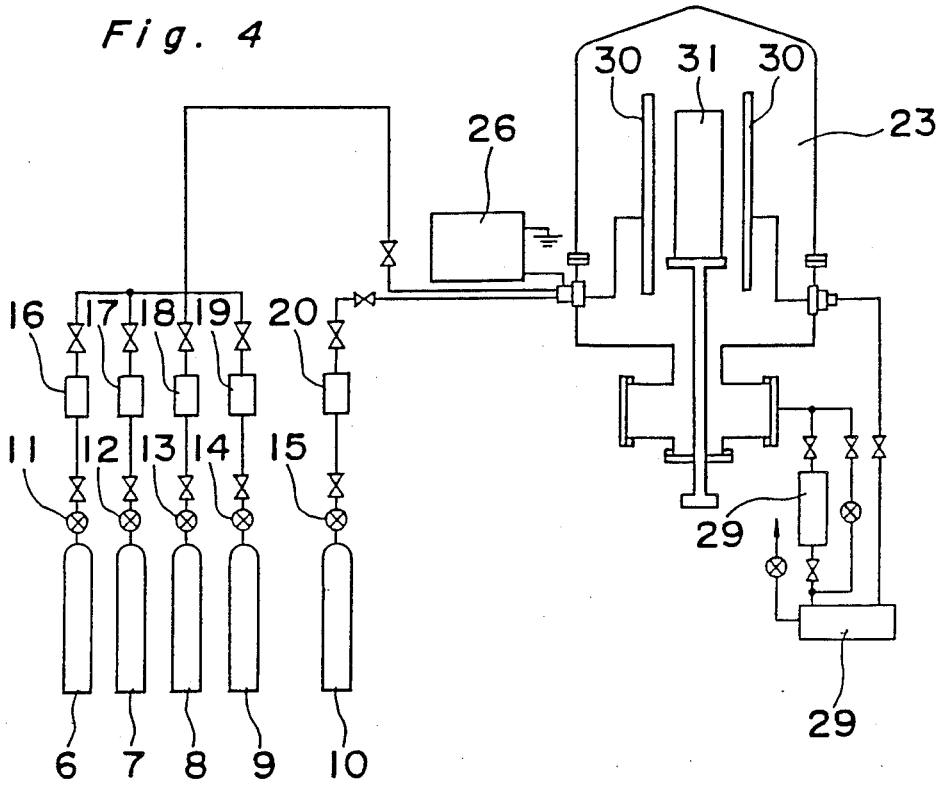

FIGS. 3 and 4 illustrate a plasma CVD equipment of capacitive coupling type for producing photosensitive members of the invention. FIG. 3 represents one of the parallel plate types and FIG. 4 one of the cylindrical types.

Electrodes (22), (25) and a substrate (24) in FIG. 3 are plate type, an electrode (30) and a substrate (31) in FIG. 4 being different in cylindrical type.

A photosensitive member of the invention may be also prepared with a plasma CVD equipment of inductive coupling type.

The illustrative production method of a photosensitive member of the invention is explained with a plasma CVD equipment of parallel plate type shown in FIG. 3.

In FIG. 3, the numerals (6)-(10) denote No.1 tank through No.5 tank which are filled with hydrocarbon gases, carrier gasses or gases for doping, each tank connected with one of five regulating valves No.1 through No.5 (11)-(15) and one of five flow controllers No.1 through No.6 (16)-(20). These gases are sent through a main pipe (21) into a reactor (23).

In the reaction chamber (23), there are a grounding electrode (25) of plate type and a power-applying electrode (22) of plate type installed oppositely. The power applying electrode (22) is connected to an audio frequency power source (26) through a condenser.

A substrate (24), for example, electroconductive substrate of plate type on which an organic photosensitive member is formed, is put on the grounding electorode (25). The plate-type electrode (22) is also connected to a direct current power source (28) through a coil (27) and can be applied with direct current bias voltages in addition to the power supply from the low frequency power source (26). A radio frequency power source may be used instead of the audio frequency power source (26).

The substrate (24) put on the electrode (25) can be heated with a heating means which is not shown. For example, an organic photosensitive member mainly constituted of thermosetting resin is heated to 100°14 200° C. Other organic photosensitive member is heated from room temperature to 100° C.

If a surface protective layer (1), such as one shown in FIG. 1 is prepared with the plasma CVD equipment above mentioned, hydrocarbon gas such as butadiene from the first tank (6), carrier gas such as $H_2$, Ar, Ne and He from the second tank (7) are provided.

An electric power of 30 watts-1Kw with the frequency of 10-1000 KHz is applied to the plate-type electrode (22) from the audio frequency power source to generate plasma-discharge between the two electrodes.

An a-C protective layer of 0.01-5 μm in thickness is formed on the preheated substrate (24).

If a radio frequency power source is used, an electric power of 50-500 W with the frequency of 13.56 MHz, for example, may be supplied.

The hydrogen content and the roughness of protuberances are dependent on the conditions of production such as the kinds of gases of law materials, the ratios of gases of raw materials to diluting gases ($H_2$, inert gas), the electric discharge power, pressure, the temperature of electrodes, DC vias voltage, the annealing temperature, the electric power frequency. The hydrogen content can be controlled by the application of bias voltage in the range of 50 V-1 KV supplied from the direct current power source (28). The bigger the bias voltage is, the lower the hydrogen content is and the harder the hardness of a-C layer itself is.

The roughness of protuberances of a protective layer or the distance between the tops of the protuberances can be bigger by lowering electric power frequency, increasing electric discharge power, lowering the pressure at the discharge, thickening a layer, heightening the temperature of substrates.

Further, the roughness and the distance may be also made bigger by annealing a photosensitive member under vacuum conditions or atomospheric conditions after the formation of a surface protective layer.

The temperature of substrates is preferably 90°-30° C. lower than the thermal deformation temperature (measured by, for example, ASTM D648) of binding resin constituting an organic photoconductive layer. If the binding resin contains more than two kinds of resin, the thermal deformation temperature is that of the most contained resin as the binder resin. When, for example, the thermal deformation temperature of the binder resin is 150° C., the temperature of substrates is preferably 60-120° C.

An a-C protective layer obtained as above mentioned is excellent in translucence, dark electrical resistance, and protecting ability for a photosensitive member.

The injection of negative or positive charges can be prevented effectively by adjusting an a-C layer to P-type or N-type. The adjustment to P-type is achieved, for example, by introducing $B_2H_6$ gas to the reactor (23) from the third tank (8) and the adjustment to N-type is achieved as similar way as the adjustment to P-type using $PH_3$ gas instead of $B_2H_6$ gas.

The heteroatoms such as oxygen atom, nitrogen atom, halogen atoms, atoms of Group IV in the periodic table, etc. can be incorporated into an a-C layer as similar way as above mentioned.

Figure 5:
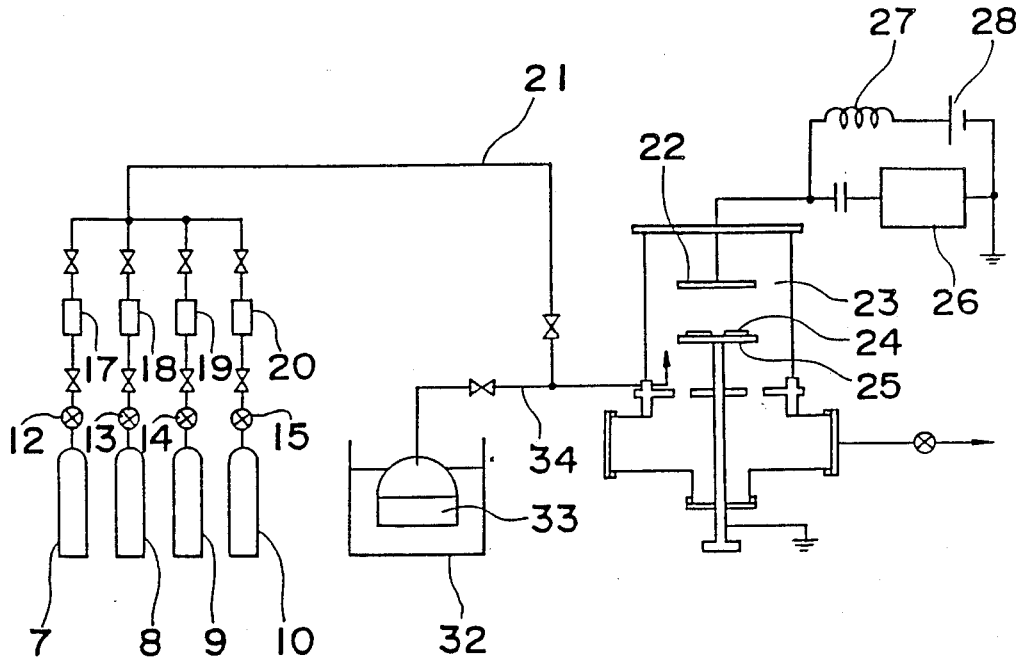

By the way , a plasma CVD equipment of capacitive coupling type shown in FIG. 5 can use such a liquid monomer (33) as $C_8H_8$, which is heated with a thermostat (32), and introduced as a gas into a reactor (23) through a heated pipe (34). The other structure of the equipment of FIG. 5 is the same as the structure of FIG. 3.

EXAMPLE (Preparation of Organic Photoconductive Layer)

First, organic photoconductive layers A-E were prepared. Organic photoconductive layers formed on aluminium plates with 50 mm in length×50 mm in width×3 mm in thickness are called organic photoconductive layer Ap–Ep, using small letter "p".

Organic photoconductive layers formed on aluminium drums of 80 mm in diameter×330 mm in length are called organic photoconductive layers Ad–Ed, using small letter "d".

Preparation of organic photoconductive layer A

Chloro-dian-blue (CDB) of 1 g as bisazo pigment, polyester resin (V-200, made by Toyobo K. K.) of 1 g and cyclohexanone of 98 g were mixed and taken in a sand-grinder for dispersion for 13 hours. The dispersion solution was dispersed onto an aluminium plate of 50 mm in length, 50 mm in width and 3 mm in thickness by a bar-coater to form a charge generating layer so that the thickness of the layer after dried could be 0.3 μm.

Then, a solution of 5 g of 4-diethylaminobenzaldehyde-diphenylhydrazone (DEH) and 5 g of polycarbonate (K-1300, made by Teijin Kasei K. K.) dissolved in 30 g of THF was applied onto the above formed charge generating layer to form a charge transporting layer so that the thickness of the layer after dried could be 15 μm. Thus, an organic photoconductive layer Ad was prepared. An organic photoconductive layer Ad was formed on an aluminium drum with 80 mm in diameter and 330 mm in length in a similar way as above mentioned except that by a dipping method instead of a bar coater method.

COMPARATIVE EXAMPLE 1

The resultant organic photoconductive layer Ap was charged to the potential of −600 V by corona discharge according to usual Carlson process and an exposure value for half reducing (called "$E_{\frac{1}{2}}$" hereinafter), which is a necessary exposure amount for the surface potential to be the half value of the initial surface potential, was measured.

$E_{2/1}$ was 2.0 lux.sec and residual potential was −5 V. The surface hardness was about 5B in pencil hardness measured according to JIS-K-5400.

JIS-K-5400 was carried out as described below.

(Summary)

JIS-K-5400 which is Pencil Scratch Test is to examine the scratch resistance of a coat to various hardness of a core of pencil from the view point of breaks of the coat.

(Scratch Tester)

Figure 6:
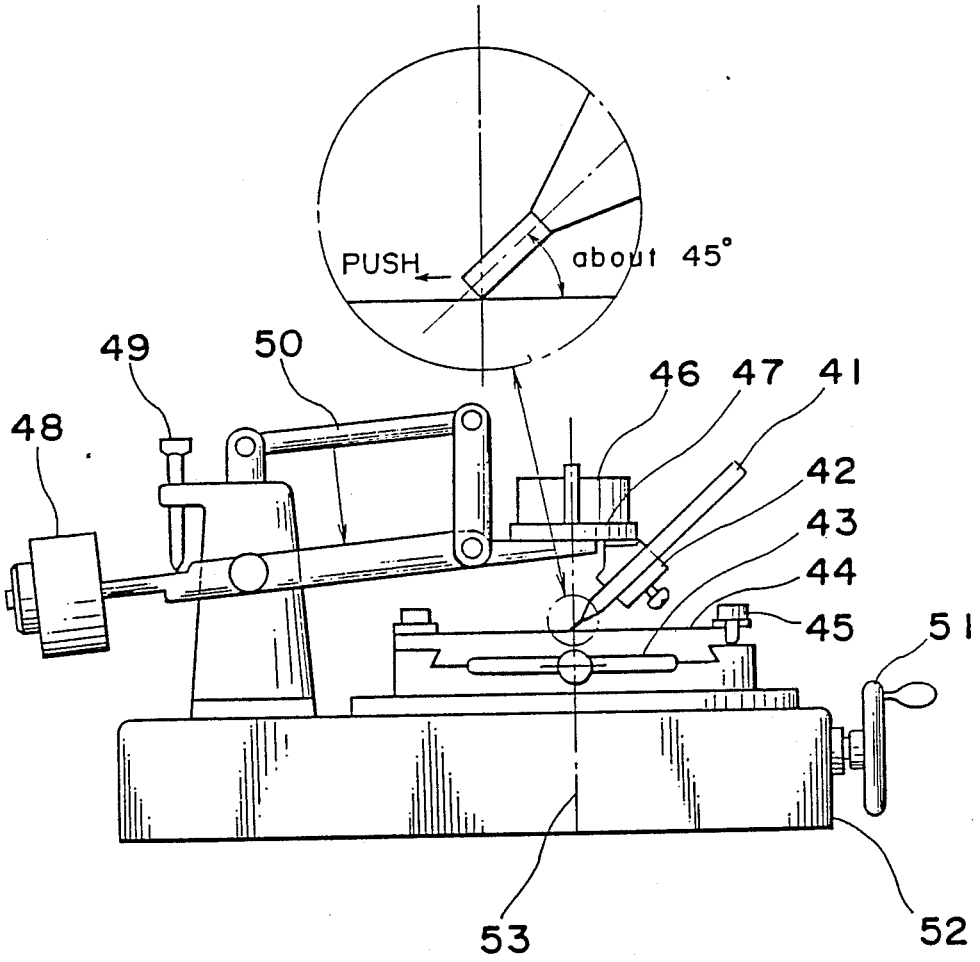
FIG. 6 is a schematic view of a pencil scratching tester for coatings.

It is useful for the examination of JIS-K-5400 to use a scratch tester specified in JIS-K-5401. The schematic view thereof was shown in FIG. 6.

(Pencil for Test)

Pencils which are specified in JIS-S-6006, produced by the same company and have properties suitable for the test should be used. The order of symbols of pencil hardness is 9H, 8H, 7H, 6H, 5H, 4H, 3H, 2H, H, F, HB, B, 2B, 3B, 4B, 5B, 6B. 9H is hardest and 6B is softest. The harder it is, the higher it shall be. (There is provided a set of pencils of every pencil hardness suitable for the invention which are selected by the foundation of NIPPON TORYO KENSA KYOKAI).

A wooden part of pencil are shaved to bare a cylindrical core of 3 mm in length, and then the core is pressed perpendicularly against a sheet of sand paper of No.400 specified JIS-R-6252 to be sharpened silently as it describes circles so that the tip of the core may be flat and the edge thereof may be sharp. The tip of pencil is re-sharpened before every scratch test.

(Method of Test)

Test specimens are prepared by applying a sample onto a one side of steel plate (about 150×70×1 mm), drying it, and then leaving it for 24 hours in a desiccator. The test specimen(44) is put horizontally on the table for the specimen installation (45) in a tester of pencil scratch so that the sample-applied side may be directed to the air side. The table for the specimen installation (45) is made so that it can move along a straight line on the horizontal plane. The line is called "movement direction".

A pencil (41) is installed in a pencil holder (42) so that the tip of the pencil may be brought into contact with the test specimen (44) at a point where a perpendicular line (53) going through the gravity center of the weight of the tester crosses the coated plane and that the angle between the axis of the pencil and the line which goes through the point and is contained in the perpendicular plane to the coated plane containing the movement direction may be 45 degrees. After a balancing weight (48) is adjusted so that the load of pencil onto the test specimen may be neither positive nor negative, a setscrew (49) is fastened, the pencil is separated from the coated plane, and the beam (50) is fixed.

The weight of 1.5±0.05 kg is loaded on a weight pan (47), the setscrew (49) is unfasten, the core of the pencil is contacted with the coated plane, and then the weight is loaded at the edge of the pencil.

Then, a handle (51) is rotated at a constant rate, the test specimen is moved about 3 mm horizontally to the opposite direction to the direction of the core to investigate whether the coatings is broken. The speed of movement shall be about 0.5 mm per second.

The specimen is shifted at right angle to the movement direction, and subjected to scratching 5 times at the different positions. If the breaks which reach to the surface of steel plate of specimen are recognized two or more times, the scratch test is carried out similarly with a pencil of one lower ranking hardness. When the breaks that reaches to the surface are recognized less than two times after 5 scratches, the symbol of pencil hardness is recorded. If the breaks which reach to the surface of steel plate of specimen is recognized less than two times, the scratch test is carried out similarly with a pencil of one higher ranking hardness. When the breaks that reaches to the surface are recognized two or more times after 5 scratches, the symbol of pencil hardness is recorded.

(Judgement)

A set of two pencils with the symbols next to each other. One pencil is obtained as above mentioned from the view point that the breaks are recognized two times or more, and the other pencil is obtained from the view point that the breaks are recognized none or one time. The symbol of the latter pencil hardness shall be the pencil scratch value of coatings.

The resultant organic photoconductive layer Ad showed as same performances as the organic photoconductive layer Ap.

As to the organic photoconductive layer Ad, it was installed in an actually used copying machine to test a copying resistance.

After the copying resistance test using 5000 sheets of A4 paper, the decrease of 1 μm in thickness of the layer was observed. Accordingly, it is understood that the organic photoconductive layer Ad is excellent in electrostatic properties but poor in durability.

Reproduction properties of fine lines were evaluated by copying a test paper for the evaluation of the reproduction properties. Black rectangles (0.5 mm×10 mm) were painted to be arranged regularly in all directions at 0.5 mm intervals on the test paper.

The organic photoconductive layer Ad was poor in reproduction properties because the rectangles were not reproduced completely in that irregular skips were observed at the edges, the long sides and the short sides of the rectangles.

Preparation of organic photoconductive layer B

Organic photoconductive layers Bp and Bd were prepared in a similar way as the preparation of the organic photoconductive layer Ap and Ad except that methyl methacrylate (PMMA) (BR-85, made by Mitsubishi Reiyon K.K.) was used instead of polycarbonate for the formation of a charge transporting layer.

COMPARATIVE EXAMPLE 2

The resultant organic photoconductive layer Bp was charged to the potential of −600 V by corona discharge according to usual Carlson process to measure $E_{\frac{1}{2}}$. $E_{\frac{1}{2}}$ was 6.2 lux.sec. The residual potential was −12 V. The surface hardness was about B in pencil hardness measured according to JIS-K-5400.

The resultant organic photoconductive layer Bd showed as same performances as the organic photoconductive layer Bp. As to the photoconductive layer Bd, it was installed in an actually used copying machine to test a copying resistance.

After the copying resistance test using 8000 sheets of A4 paper, the decrease of 1 μm in thickness of the layer was observed.

Accordingly, it is understood that the organic photoconductive layer Bd is excellent in electrostatic properties but poor in durability.

Reproduction properties of fine lines were evaluated by copying a test paper for the evaluation of the reproduction properties. Black rectangles (0.5 mm×10 mm) were painted to be arranged regularly in all directions at 0.5 mm intervals on the test paper.

The organic photoconductive layers Bd was poor in reproduction properties because the rectangles were not reproduced completely in that irregular skips were observed at the edges, the long sides and the short sides of the rectangles.

Preparation of organic photoconductive layer C

Organic photoconductive layers Cp and Cd were prepared in a similar way as the preparation of the organic photoconductive layer Ap and Ad except that polyallylate (U-4000, made by Yunichika K.K.) was used instead of polycarbonate.

COMPARATIVE EXAMPLE 3

The resultant organic photoconductive layer Cp was charged to the potential of −600 V by corona discharge according to usual Carlson process to measure $E_{\frac{1}{2}}$. $E_{\frac{1}{2}}$ was 2.3 lux.sec. The residual potential was −8 V. The surface hardness was about 5B in pencil hardness measured according to JIS-K-5400.

The resultant organic photoconductive layer Cd showed as same performances as the organic photoconductive layer Cp. As to the photoconductive layer Cd, it was installed in an actually used copying machine to test a copying resistance.

After the copying resistance test using 4000 sheets of A4 paper, the decrease of 1 μm in thickness of the layer was observed.

Accordingly, it is understood that the organic photocanductive layer Cd is excellent in electrostatic properties but poor in durability.

Reproduction properties of fine lines were evaluated by copying a test paper for the evaluation of the reproduction properties. Black rectangles (0.5 mm×10 mm) were painted to be arranged regularly in all directions at 0.5 mm intervals on the test paper.

The organic photoconductive layers Cd was poor in reproduction properties because the rectangles were not reproduced completely in that irregular skips were observed at the edges, the long sides and the short sides of the rectangles.

Preparation of organic photoconductive layer D

Organic photoconductive layers Dp and Dd were prepared in a similar way as the preparation of the organic photoconductive layer Ap and Ad except that polyester (V-200, made by Toyobo K.K.) was used instead of polycarbonate.

COMPARATIVE EXAMPLE 4

The resultant organic photoconductive layer Dp was charged to the potential of −600 V by corona discharge according to usual Carlson process to measure $E_{\frac{1}{2}}$. $E_{\frac{1}{2}}$ was 2.2 lux.sec. The residual potential was −7 V. The surface hardness was about 5B in pencil hardness measured according to JIS-K-5400.

The resultant organic photoconductive layer Dd showed as same performances as the organic photoconductive layer Dp. As to the photoconductive layer Dd, it was installed in an actually used copying machine to test a copying resistance.

After the copying resistance test using 5000 sheets of A4 paper, the decrease of 1 μm in thickness of the layer was observed.

Accordingly, it is understood that the organic photoconductive layer Dd is excellent in electrostatic properties but poor in durability.

Reproduction properties of fine lines were evaluated by copying a test paper for the evaluation of the reproduction properties. Black rectangles (0.5 mm×10 mm) were painted to be arranged regularly in all directions at 0.5 mm intervals on the test paper.

The organic photoconductive layers Dd was poor in reproduction properties because the rectangles were not reproduced completely in that irregular skips were observed at the edges, the long sides and the short sides of the rectangles.

Preparation of organic photoconductive layer E

Special α-type copper phthalocyanine (made by Toyo Ink K.K.) of 25 parts by weight, thermosetting acrylic melamine resine (a mixture of A-405 with Super Beckamine J 820; made by Dainippon Ink K.K.) of 50 parts by weight and 4-diethylamino-benzaldehyde-diphenylhydrazone of 25 parts by weight were mixed in the organic solvent (mixture of xylene of 7 parts by weight with butanol of 3 parts by weight) of 500 parts by weight, ground and dispersed with ball mills for 10 hours.

Then the dispersion solution was dispersed onto an aluminium plate of 50 mm in length, 50 mm in width and 3 mm in thickness by a bar-coater to form an organic photoconductive layer Ep so that the thickness of the layer after annealed for 1 hour at the temperature of 150° C. could be 15 μm.

An organic photoconductive layer Ed was formed on an aluminium drum with 80 mm in diameter and 330 mm in length in a similar was as above mentioned except that by dipping method instead of a bar coater method.

COMPARATIVE EXAMPLE 5

The resultant organic photoconductive layer Ep was charged to the potential of +600 V by corona discharge according to usual Carlson process to measure $E_{\frac{1}{2}}$. $E_{\frac{1}{2}}$ was 4.3 lux.sec. The residual potential was +5 V. The surface hardness was about B in pencil hardness measured according to JIS-K-5400.

The resultant organic photoconductive layer Ed showed as same performances as the organic photoconductive layer Ep. As to the photoconductive layer Ed, it was installed in an actually used copying machine to test a copying resistance.

After the copying resistance test using 10000 sheets of A4 paper, the decrease of 1 μm in thickness of the layer was observed.

Accordingly, it is understood that the organic photoconductive layer Ed is excellent in electrostatic properties but poor in durability.

Reproduction properties of fine lines were evaluated by copying a test paper for the evaluation of the reproduction properties. Black rectangles (0.5 mm×10 mm) were painted to be arranged regularly in all directions at 0.5 mm intervals on the test paper. The organic photoconductive layers Ed was poor in reproduction properties because the rectangles were not reproduced completely in that irregular skips were observed at the edges, the long sides and the short sides of the rectangles.

EXAMPLE 1

(Preparation of surface protective layer)

An a-C protective layer of the invention was prepared on the organic photoconductive layer Ad as described below.

In a system of glow discharge decomposition with equipment illustrated in FIG. 4, first the reaction chamber (23) was vacuumized inside to a high level of approximately $10^{-6}$ Torr, and then by opening No.1 and No.2 regulating valves (11) and (12), butadiene gas from No.1 tank (6) and hydrogen gas from No.2 tank(7) were led, under output pressure gage reading of 1 kg/cm$^2$, into mass flow controller (16) and (17).

Then, the mass flow controllers were set so as to make butadiene flow at 60 sccm and hydrogen flow at 300 sccm and the gases were allowed into the reaction chamber (23). After the respective flows had stabilized, the internal pressure of the reaction chamber (23) was adjusted to 0.5 Torr. On the other hand, the electrically conductive substrate (31), which was cylindrical substrate on which the organic photoconductive layer Ad was formed, was preliminarily heated up to 90° C., and while the gas flows and the internal pressure were stabilized, it was connected to the audio frequency power source (26) and 160 watts power (frequency: 50 KHz) was applied to the cylindrical electrode (30).

After plasma ploymerization for approximately five minutes, there was formed an a —C surface protective layer containing about 38 atm. % of hydrogen with the thickness of approximately 0.5 μm, the roughness of approximately 0.8 μm and the distance of approximately 3.5 μm on the organic photoconductive layer Ad.

The obtained photosensitive member was evaluated on electrostatic properties, hardness, copying resistance and reproduction properties of fine lines.

The static properties were nearly as same as those of the organic photoconductive layer Ap (comparative example 1).

The hardness was measured according to JIS-K5400 about an a-C layer formed on a glass plate so as not to be influenced by the organic photoconductive layer.

Further, the adhesivity was evaluated as described below.

The photosensitive member was left under such environments for 6 hours that the low temperature and low humidity atmosphere of 10° C. of temperature and 30% of relative humidity, and the high temperature and high humidity atmosphere of 50° C. of temperature and 90% of relative humidity were repeated by turns at 30 minutes intervals.

The peeling off or the cracking of the surface protective layer was not observed and it was understood that the surface protective layer of the invention was excellent in adhesivity with the photoconductive layer.

The obtained photosensitive member was installed in the really used copying machine EP 470Z made by Minolta Camera K.K. to evaluate copying resistance when provided to the real developing process. It gave clear copy images and that image flows were not observed when it was used in the real developing process under conditions of 35° C. of temperature and 80% of relative humidity. The contact of the photosensitive member with developers, sheets of copying paper and cleaning members in the copying machine did not cause the peeling off of the surface protective layer. Even after 250000 sheets of paper were developed with the really used machine in the usual temperature, the decrease of thickness of the photosensitive member were not observed to find that the surface protective layer of the invention can achieve the improvement of durability and resistance to injury without the deterioration of image quality.

Reproduction properties of fine lines were evaluated by copying a test paper for the evaluation of the reproduction properties. Black rectangles (0.5 mm×10 mm) were painted to be arranged regularly in all directions at 0.5 mm interval on the test paper. Even after 250000 sheets of paper were developed, the reproduction properties were good in that irregular skips were not observed at the edges, the long sides and the short sides of the rectangles.

The results above mentioned were shown in Table 1 along with the preparation conditions of the surface protective layers.

The symbols Ap, Bp, Cp, Dp and Ep shown in the column of electrostatic properties of Table 1 mean that the electrostatic properties is nearly equal to those of Ap–Ep obtained in the comparative examples 1–5 respectively.

The symbols "O" in the Table 1 means that the copying resistance and the reproduction properties of fine lines were as nearly equal as those in the example 1 above mentioned.

EXAMPLE 2-16

A-C layers were formed on the surfaces of organic photoconductive layers Bd-Ed and evaluated in a similar way as Example 1. The preparation conditions of the a-C layers and the evaluation results were shown in Table 1.

EXAMPLE 17

A photosensitive member with a surface protective layer, the surface of which is flat, was prepared under plasma polymerization conditions as shown in Table 1. The resultant photosensitive member was annealed for 3 hours at 80° C. under vacuum to make its surface irregular.

COMPARATIVE EXAMPLE 6

The roughness of 0.8 μm was given to the organic photoconductive layer Bd by abrading with abrasives.

The electrostatic properties and the pencil hardness of the organic photoconductive layer Bd were as nearly equal as those of Bp.

The organic photoconductive layer Bd was installed in the really used copying machine and subjected to the copying resistant test. The protuberances and hollows on the surface were used up when 5000 sheets of A4 paper were developed.

Further, the reproduction properties of fine lines were evaluated in a similar way as in Example 1. The reproduction properties of fine lines were good at first, but skips came to be observed at the edges, the long sides and the short sides of the rectangles after the development of about 5000 sheets of paper.

TABLE 1

| | Example | 1 | 2 | 3 | 4 | 5 | 6 | 7 | 8 |
|---|---|---|---|---|---|---|---|---|---|
| | organic photo-conductive layer | Ad | Bd | Cd | Dd | Ed | Ad | Bd | Cd |
| raw material gas | hydrocarbon (sccm) | butadiene 60 | butadiene 60 | butadiene 60 | butadiene 60 | butadiene 60 | propylene 100 | propylene 100 | propylene 100 |
| | carrier gas (sccm) | hydrogen 300 | hydrogen 300 | hydrogen 300 | hydrogen 300 | hydrogen 300 | hydrogen 300 | hydrogen 300 | hydrogen 300 |
| plasma polymerization condition | substrate temperature (°C.) | 90 | 90 | 90 | 90 | 120 | 70 | 70 | 70 |
| | frequency (KHz) | 50 | 50 | 50 | 50 | 50 | 50 | 50 | 50 |
| | power (W) | 160 | 160 | 160 | 160 | 160 | 160 | 160 | 160 |
| | pressure (Torr) | 0.5 | 0.5 | 0.5 | 0.5 | 0.5 | 0.5 | 0.5 | 0.5 |
| | time (minute) | 5 | 5 | 5 | 5 | 5 | 2 | 2 | 2 |
| protective layer | layer thickness (μm) | 0.5 | 0.5 | 0.5 | 0.5 | 0.5 | 0.25 | 0.25 | 0.25 |
| | roughness (a) (μm) | 0.8 | 0.8 | 0.8 | 0.8 | 0.8 | 0.3 | 0.3 | 0.3 |
| | distance (b) (μm) | 3.5 | 3.5 | 5 | 8 | 10 | 5 | 5 | 6 |
| properties of photo-sensitive member | electro-* static properties | Ap | Bp | Cp | Dp | Ep | Ap | Bp | Cp |
| | hardness | 9 H | 9 H | 9 H | 9 H | 9 H | 9 H | 9 H | 9 H |
| | copying resistance | o | o | o | o | o | o | o | o |
| | reproduction properties of fine line | o | o | o | o | o | o | o | o |

| | Example | 9 | 10 | 11 | 12 | 13 | 14 | 15 | 16 |
|---|---|---|---|---|---|---|---|---|---|
| | organic photo-conductive layer | Dd | Ed | Dd | Ed | Ad | Ad | Bd | Cd |
| raw materials gas | hydrocarbon (sccm) | propylene 100 | propylene 100 | butadiene 60 | butadiene 60 | butadiene 100 | butadiene 100 | propylene 50 | propylene 30 |
| | carrier gas (sccm) | hydrogen 300 | hydrogen 300 | hydrogen 300 | hydrogen 300 | hydrogen 60 | hydrogen 60 | hydrogen 500 | hydrogen 500 |
| plasma polymerization condition | substrate temperature (°C.) | 70 | 100 | 100 | 140 | 60 | 60 | 70 | 70 |
| | frequency (KHz) | 50 | 50 | 50 | 50 | 1 MHz | 500 | 1 MHz | 200 |
| | power (W) | 160 | 160 | 300 | 300 | 130 | 130 | 220 | 220 |
| | pressure (Torr) | 0.5 | 0.5 | 0.5 | 0.5 | 1.3 | 1.3 | 0.3 | 0.3 |
| | time (minute) | 2 | 2 | 5 | 5 | 3 | 3 | 10 | 15 |
| protective layer | layer thickness (μm) | 0.25 | 0.25 | 1.2 | 1.2 | 0.3 | 0.3 | 0.3 | 0.3 |
| | roughness (a) (μm) | 0.3 | 0.3 | 5 | 9 | 0.5 | 0.5 | 0.5 | 1.0 |
| | distance (b) (μm) | 9 | 11 | 5 | 5 | 5 | 5 | 15 | 19 |
| properties of photo- | electro-* static | Dp | Ep | Dp | Ep | Ap | Ap | Bp | Cp |

TABLE 1-continued

| | | | | | | | | | |
|---|---|---|---|---|---|---|---|---|---|
| sensitive member | properties | | | | | | | | |
| | hardness | 9 H | 9 H | 9 H | 9 H | 3 H | 6 H | 9 H | 9H |
| | copying resistance | o | o | o | o | o | o | o | o |
| | reproduction properties of fine line | o | o | o | o | o | o | o | o |

| | | | |
|---|---|---|---|
| | | Example | 17 |
| | | organic photo-conductive layer | Ad |
| | raw materials gas | hydrocarbon (sccm) | butadiene 60 |
| | | carrier gas (sccm) | hydrogen 300 |
| | plasma poylmerization condition | substrate temperature (°C.) | 40 |
| | | frequency (KHz) | 80 |
| | | power (W) | 80 |
| | | pressure (Torr) | 1.0 |
| | | time (minute) | 2 |
| | protective layer | layer thickness (μm) | 0.15 |
| | | roughness (a) (μm) | 0.1 |
| | | distance (b) (μm) | 3** |
| | properties or photo-sensitive member | electro-* static properties | Ap |
| | | hardness | 7 H |
| | | copying resistance | o |
| | | reproduction properties of fine line | o |

*The symbols Ap, Bp, Cp, Dp, and Ep mean that the electrostatic properties are nearly equal to those of AP-Ep obtained in the comparative example, 1-5 respectively.
**After the formation of the surface protective layer, its surface was flat and both the roughness (a) and the distance (b) could not be measured. After the annealing treatment for 3 hours at 80° C. under vacuum condition, the irrelularity of the roughness (a) = 0.1 μm and the distance (b) = 3 μm was obtained.

What is claimed is:

1. A photosensitive member comprising an electrically conductive substrate having a substantially smooth surface, a photoconductive layer formed on said substantially smooth surface of said electrically conductive substrate and a surface protective layer formed on said photoconductive layer, wherein the photoconductive layer is organic and the surface protective layer is formed of an amorphous carbon layer with non-directive upheave patterns on the surface thereof, said non-directive upheave patterns are formed by a combination of protuberant parts and hollow parts and have 0.1 to 20 μm in a first distance between a top of said protuberant part and an adjoining bottom of said hollow part as well as 1 to 40 μm in a second distance between a top of one of said protuberant parts and an adjoining top of a second of said protuberant parts.

2. A photosensitive member of claim 1, wherein the non-directive upheave patterns have 0.2 to 15 μm in said first distance as well as 2 to 3 μm in said second distance.

3. A photosensitve member of claim 1, wherein the non-directive upheave patterns have 0.3 to 10 μm in said first distance as well as 3 to 20 μm in said second distance.

4. A photosensitive member of claim 1, wherein the surface protective layer has 0.05 to 5 μm in thickness.

5. A photosensitive member of claim 1, wherein the surface protective layer has 0.1 to 2.5 μm in thickness.

6. A photosensitive member of claim 1, wherein the surface protective layer has 0.2 to 1.2 μm in thickness.

7. A photosensitive member of claim 1, wherein the surface protective layer has 0.1 to 2.5 μm in thickness and is formed by a glow discharge method.

8. A photosensitive member comprising an electrically conductive substrate having a substantially smooth surface, a photoconductive layer formed on said substantially smooth surface of said electrically conductive substrate and a surface protective layer formed on said photoconductive layer, wherein the photoconductive layer is organic and the surface protective layer is formed of an amorphous carbon layer formed by a glow discharge method, and wherein the surface protective layer has non-directive upheave patterns formed by an annealing treatment so as to be composed of protuberant parts and hollow parts, said non-directive upheave patterns having 0.1 to 20 μm in a first distance between a top of said protuberant part and an adjoining bottom of said hollow part as well as 1 to 40 μm in a second distance between a top of one of said protuberant parts and an adjoining top of a second of said protuberant parts.

* * * * *

UNITED STATES PATENT AND TRADEMARK OFFICE

CERTIFICATE OF CORRECTION

PATENT NO. : 4,933,247

DATED : June 12, 1990

INVENTOR(S) : Izumi OSAWA, et al.

It is certified that error appears in the above-identified patent and that said Letters Patent is hereby corrected as shown below:

In Claim 2, line 62, Column 17, change "said first distance as well as 2 to 3 μm" to --said first distance as well as 2 to 30 μm--

Signed and Sealed this

Tenth Day of November, 1992

*Attest:*

DOUGLAS B. COMER

*Attesting Officer*

*Acting Commissioner of Patents and Trademarks*